US009956475B1

(12) United States Patent
Campbell et al.

(10) Patent No.: US 9,956,475 B1
(45) Date of Patent: May 1, 2018

(54) GAME ACTION FIGURE FOR USE IN GAME AND CONTAINING STORAGE FOR GAME PIECES

(71) Applicants: James Campbell, Akron, OH (US); Benjamin Cichoski, Cumberland, RI (US); Daniel Mandel, Cumberland, RI (US)

(72) Inventors: James Campbell, Akron, OH (US); Benjamin Cichoski, Cumberland, RI (US); Daniel Mandel, Cumberland, RI (US)

( * ) Notice: Subject to any disclaimer, the term of this patent is extended or adjusted under 35 U.S.C. 154(b) by 244 days.

(21) Appl. No.: 14/998,913

(22) Filed: Mar. 3, 2016

(51) Int. Cl.
*A63F 1/04* (2006.01)
*A63H 3/00* (2006.01)

(52) U.S. Cl.
CPC ..... *A63F 1/04* (2013.01); *A63H 3/005* (2013.01)

(58) Field of Classification Search
None
See application file for complete search history.

(56) References Cited

U.S. PATENT DOCUMENTS 8,152,587 B1 * 4/2012 Brown ..... A63H 3/02 206/216
8,613,639 B2 * 12/2013 Hengel ..... A63H 3/02 446/73
2006/0205319 A1 * 9/2006 Colvin ..... A63H 3/005 446/369

* cited by examiner

*Primary Examiner* — Sunit Pandya

(57) ABSTRACT

A game action figure for use in a tabletop combat game with other game action figures is disclosed. The game action figure includes a body having arms and legs; a lower housing, the lower housing including a first storage location for a pair of dice, a second storage location for a set of cards, a hexagonal spacer, and a weapon held by one of the arms during game play, and a third storage location for a measuring string; and an upper housing, the upper housing configured to attach to the lower housing and enclose a space between the lower and upper housing in which the set of cards, hexagonal spacer and measuring string are stored.

6 Claims, 6 Drawing Sheets

GAME ACTION FIGURE FOR USE IN GAME AND CONTAINING STORAGE FOR GAME PIECES

FIELD OF THE INVENTION

The present invention relates broadly to games and toys. More particularly, the present invention relates to a game action figure that is moved around a table combating other game action figures with the assistance of a measuring string, deck of cards and dice, all of which are stored inside the game action figure when not in use.

BACKGROUND OF THE INVENTION

Games are played by many people for entertainment, social gatherings and for entertainment. Games can take a variety of forms and can include pieces, cards and boards. A number of patents and or publications have been made to address these issues. Exemplary examples of patents and or publication that try to address this/these problem(s) are identified and discussed below.

U.S. Pat. No. 6,530,571 issued on Mar. 11, 2003 to Patricia McWilliams discloses a game board having a representation of a baseball playing field is provided. Cards containing questions about the sport are divided into regular question and "challenge" question cards. When batting, a player uses a chance determining device to determine the outcome of an at bat, preferably either a "hit" or "out". While this game uses questions it operates like a baseball game as opposed to players attacking each other.

U.S. Pat. No. 7,249,764 issued on Jul. 31, 2007 to Don R. Donovan discloses a board game set-up so that a group of people each control a single game figure and play against a single person who controls a group of game figures. The game board includes a number of castle spaces which each have a treasure card. While this game allows for multiple people to play, it does not defeat opponents by attacks.

U.S. Pat. No. 7,562,874 issued on Jul. 21, 2009 to Lawrence L. White discloses a method of playing the board game includes an annular board game that has a planar top surface provided with indentations that intersect at a center of the board such that the board is divided into four quadrants. Annular and square recesses are created in each quadrant. While this game provides ma board game for play, the players do not reduce the health of the opponents.

BRIEF SUMMARY OF THE INVENTION

It is an object of the present invention to provide a card-driven combat game using game action figures for two or more players. It is an object of the present invention for each player to controls one toy figure that moves around the table, and uses their deck of cards to attacks enemy figures, and attempts to defeat their opponent by reducing the opponent's health to zero.

It is an object of the present invention to provide cards that direct players to move, attack, defend, and perform special actions. Combat results are determined by a roll of a pair of dice.

It is an object of the present invention for each figure to include health cards and starting terrain cards in addition to the health and terrain cards, a number of personalized deck cards. The cards in a player's deck can be mixed and matched between figures.

It is another object of the present invention for the cards to have different types like attack, defense, move, special, terrain, unit, etc. These cards are designed as a fully realized card game, with deck building rules, keywords, combos, and so on. Each toy comes with a fixed set of cards themed for that figure.

It is another object of the present invention to include a measuring string broken up into three colored sections. The string is used for line of movement, movement length, distance of range attacks and line of sight for range attacks. The colors of the string are for different movement and range lengths. For example, short ranged attacks just use the green part of the string.

It is another object of the present invention to have two types of attack cards: range and melee. Melee attack cards can only be played when a figure's base is touching another figure's base.

It is still another object of the present invention for the game to be played in a variety of ways (free-for-all, duel, team, scenario, etc.). The default game ends when one figure or team is the last figure standing.

In one aspect, the present invention provides a game action figure for use in a tabletop combat game with other game action figures, having a body having arms and legs; a lower housing, the lower housing including a first storage location for a pair of dice, a second storage location for a set of cards, a hexagonal spacer, and a weapon held by one of the arms during game play, and a third storage location for a measuring string; and an upper housing, the upper housing configured to attach to the lower housing and enclose a space between the lower and upper housing in which the set of cards, hexagonal spacer and measuring string are stored.

In an embodiment, the first storage location includes a pair of apertures, each dimensioned to retain one die of the pair of dice.

In an embodiment, the cards are hexagonal in shape.

In an embodiment, the third storage location includes a pair of holes in which ends of the string are placed and inserted into the lower housing.

In an embodiment, the lower housing and upper housing together present a head for the game action figure supported by the body having arms and legs.

In an embodiment, the hex spacer/platform is constructed from a transparent material.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1A:
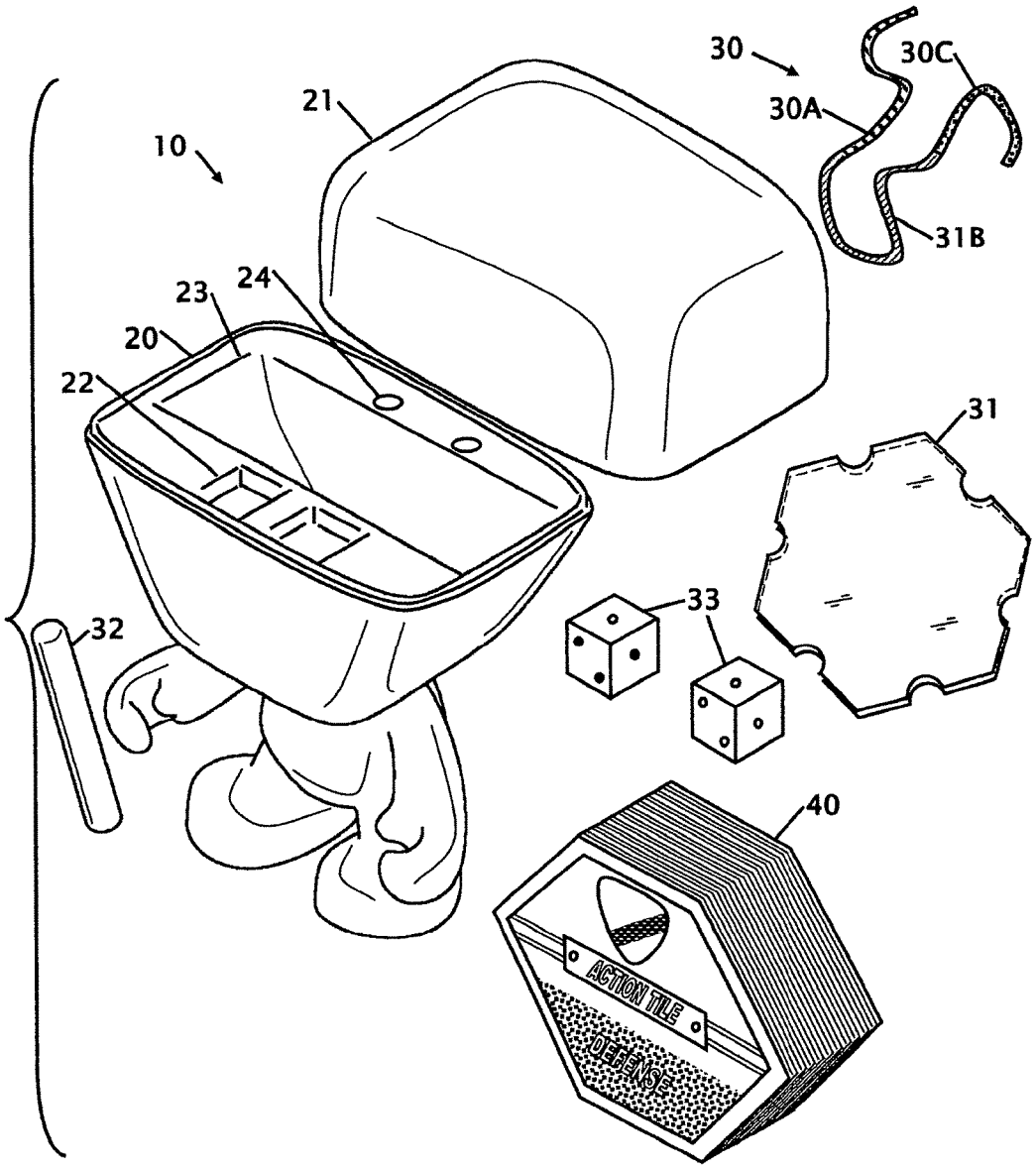
FIG. 1A shows a game action figure of the present invention with game pieces stored inside.
Figure 1B:
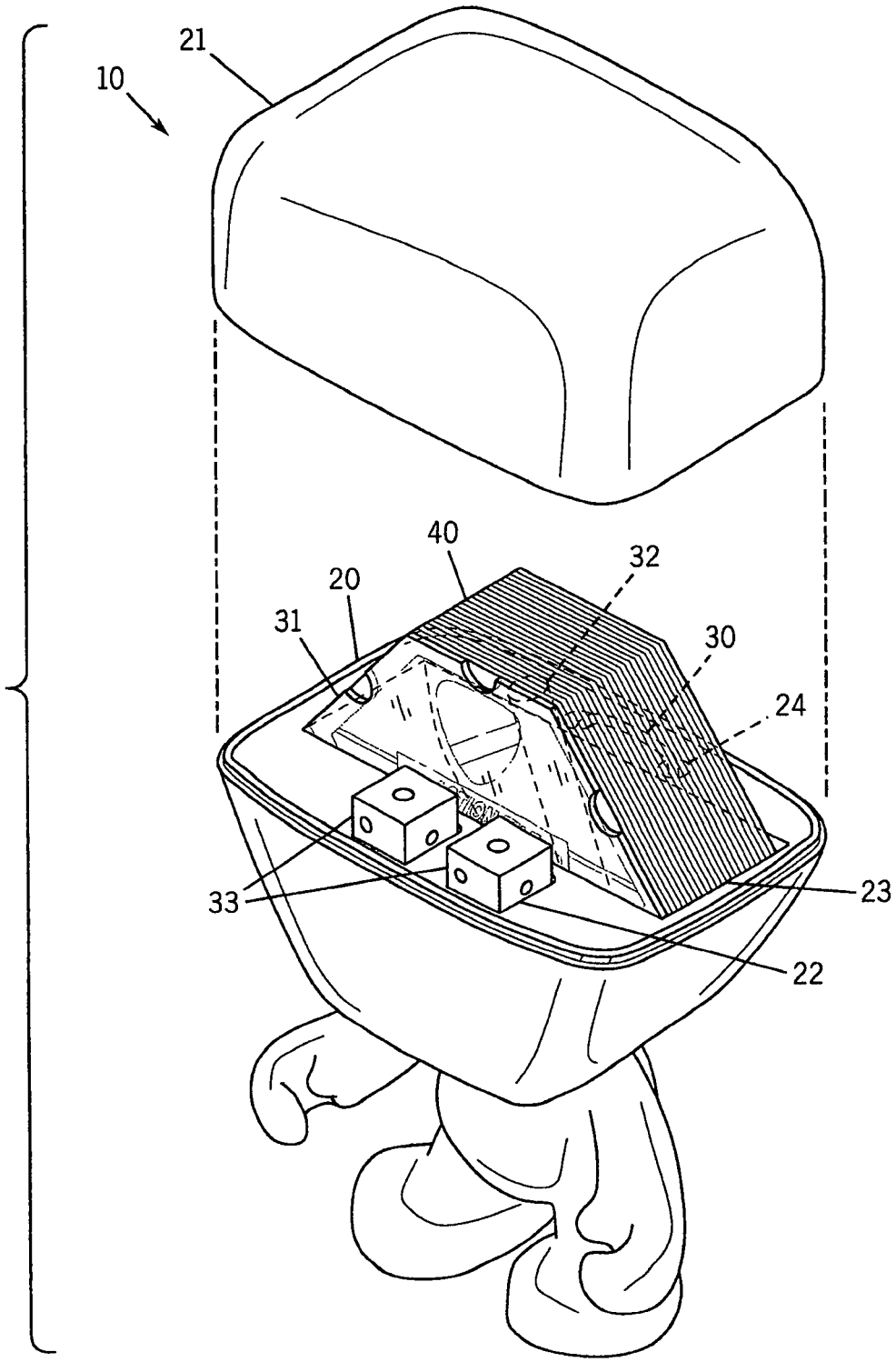
FIG. 1B shows the game action figure shown in FIG. 1 with the game pieces removed.

FIGS. 1A and 1B show an exemplary game action FIG. 10. As shown, game action FIG. 10 has a lower housing 20 and an upper housing 21, enclosing a plurality of game elements or pieces used during game play in which game action FIG. 10 serves as an action figure used in a tabletop game. All of the game pieces and cards fit and are stored within the housings. At location 22, dice 33 are stored in a pair of apertures dimensioned to each accept and retain a single die. At location 23, there is storage for string 30, hex spacers/platform 31, weapon 32 and cards 40. The holes shown at location 24 are to hold the ends of string 30. Weapon 32, as shown, fits in the hands of game FIG. 10 during play. In an embodiment, hex spacer/platform 31 is constructed from a transparent material such as plastic so that when hex spacer/platform is placed on top of one of cards 40, the face of card 40 is still visible beneath hex spacer/platform 31.

While the game is played with a variety of housing sets 21 and 22, having different character art, only a single game action FIG. 10 is shown in FIGS. 1A and 1B as an example. FIGS. 1A and 1B thus show how game pieces are effectively stored within game action FIG. 10. The game is typically played on a table or other surface as described below. Each game set has a pair of dice 33, a length of string 30 having three different colors 30A, 30B and 30C along the length of the string 30, hex spacers/platform 31 for measuring a line-of-sight and a deck of cards 40. The deck of cards includes a plurality of attacks where one play is the attacker and another player is a defender.

Figure 2:
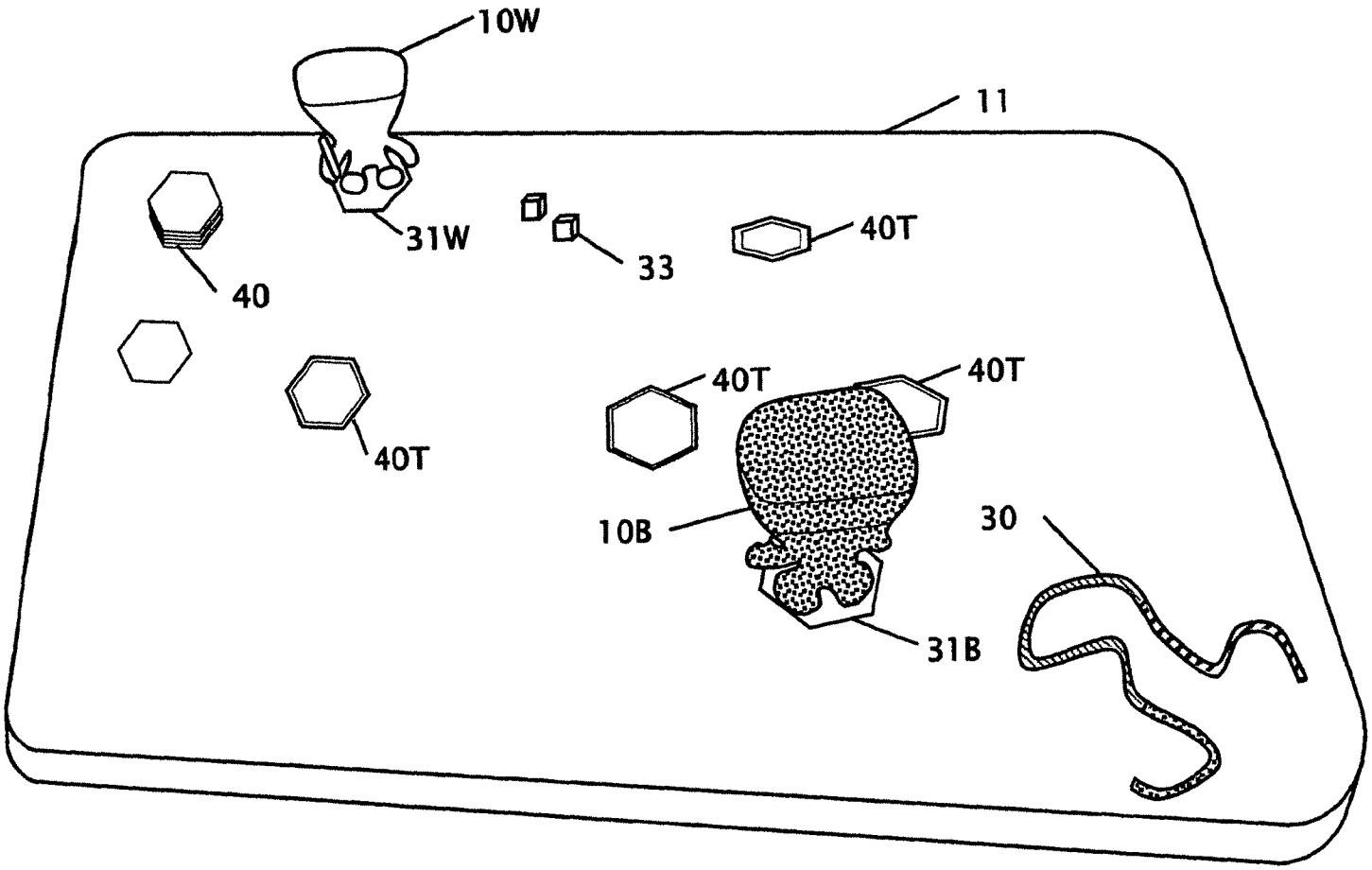
FIG. 2 shows an initial set-up for game play.

FIG. 2 shows an initial set-up for game play on a table 11 or other suitable surface. On the table is a black action FIG. 10B and a white action FIG. 10W. Each of the FIGS. 10B and 10W are placed on hex spacers/platform 31B and 31W respectively. The dice 33 are shown on the table with a plurality of cards 40 and a length of string 30. The dice have sides of blue, green and red dots that determine the actions that can be taken during play. The measuring string 30 broken up into three colored sections. The string 30 is used for line of movement, movement length, distance of range attacks and line of sight for range attacks. The colors green, yellow and red of the string are for different movement and range lengths. For example, short ranged attacks just use the green part of the string.

Figure 3:
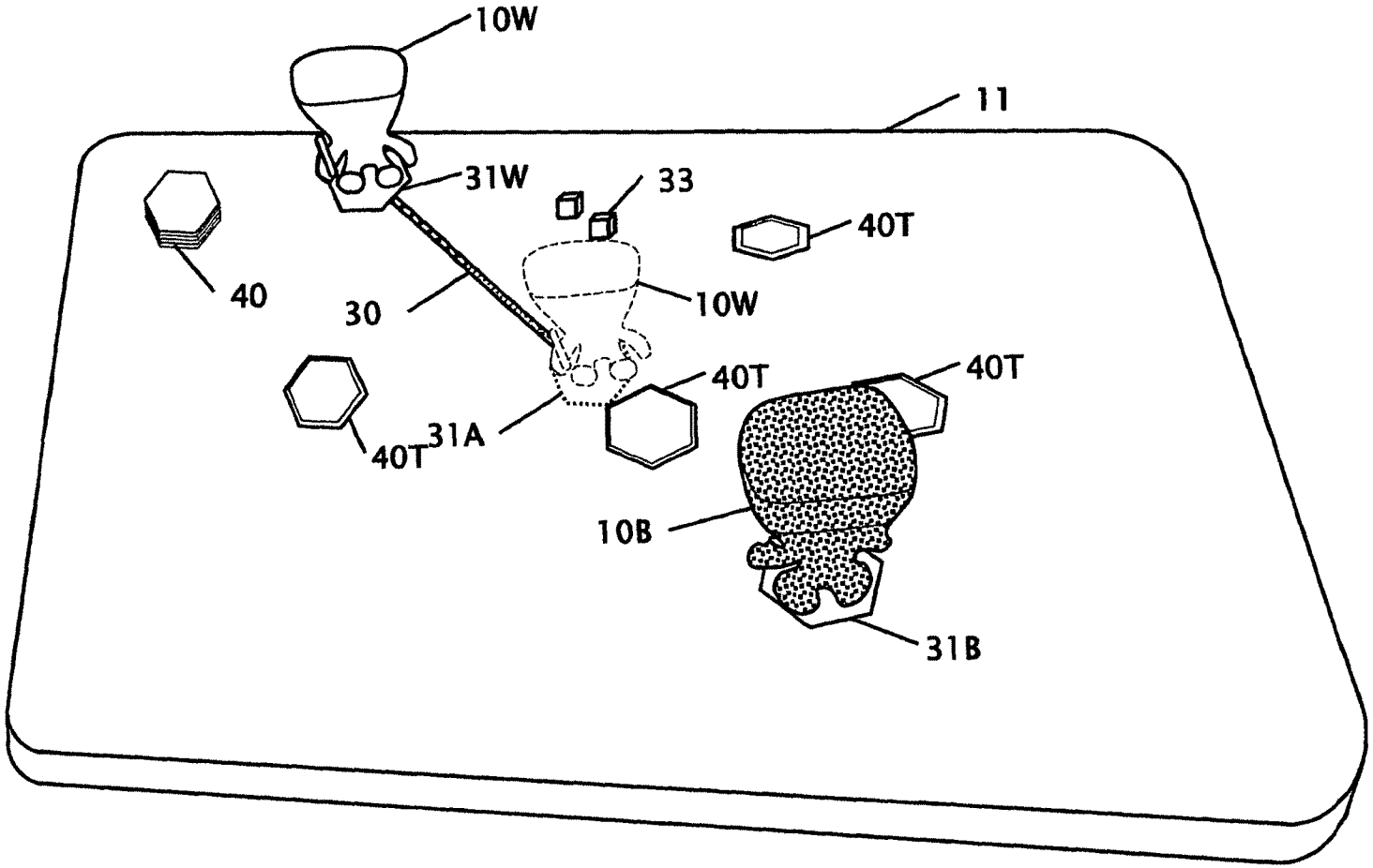
FIG. 3 shows a first move.

FIG. 3 shows a first move. The user of action FIG. 10W places down hex spacer/platform 31W on table 11 and then verifies that the move is allowable by checking that the position is within the range of their string 30. If the move is acceptable the white player moves their figure to the new position, shown as broken line player 10W.

Figure 4:
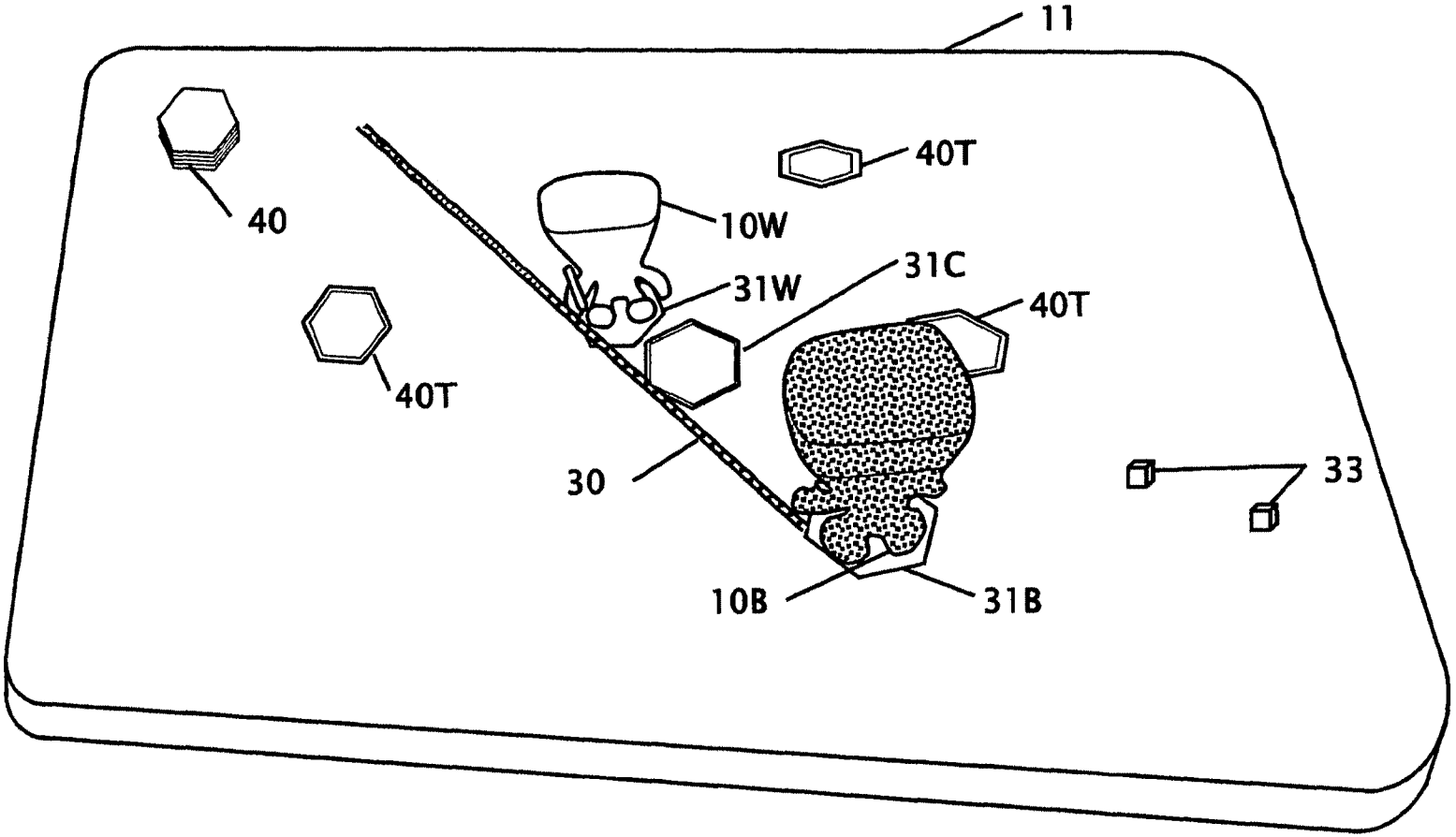
FIG. 4 shows an opponent's first move as an attack.

FIG. 4 shows an opponent's first move as an attack. In this figure, action FIG. 10B makes a short range attack and verifies that action FIG. 10W is within the attack range of the string. The short attack is within the length of the green portion of the string. If this is acceptable action FIG. 10B's attacking player rolls both dice 33 looking for green hits. The defending player of action FIG. 10W also rolls both dice 33 looking for red hits. In this figure card 31C provides "cover" protection.

Players move around the table 11 taking turns moving the FIGS. 10B and 10W under the following rules.

Figures 5, 6:
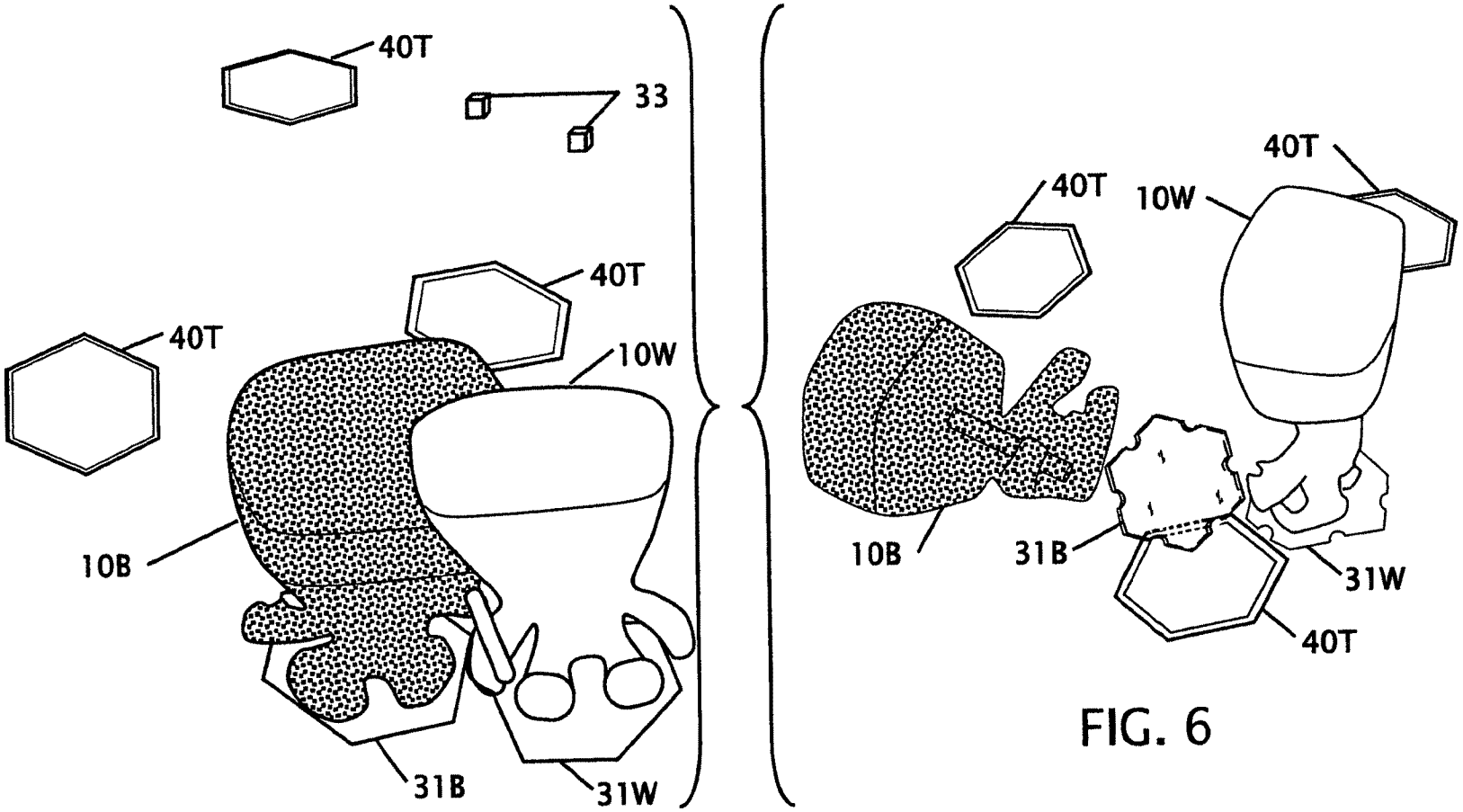
FIG. 5 shows bases touching whereby a melee can occur.
FIG. 6 shows the end of the game.

FIG. 5 shows bases touching whereby a melee can occur.

Action FIGS. 10B and 10W are used in a card-driven 40 combat game for two or more players. Each player controls one toy FIG. 10B, 10W that moves around the table 11, attacks enemy figures, and uses their deck of cards to attack enemy figures, and attempts to defeat their opponent by reducing their opponent's health to zero. Everything a player needs to play is stored in the head of the game action FIG. 10.

Deck Building

Each game action FIG. 10B, 10W comes with health cards and starting terrain cards in addition to the health and terrain cards, a number of personalized deck cards. The cards in a player's deck can be mixed and matched between figures. In a preferred embodiment there are five health cards and three starting terrain cards in addition to its 36-card personalized deck. The cards 40 in a player's deck can be mixed and matched between action FIGS. 10B and 10W. The terrain cards 40T are placed on the playing table at locations identified by the players.

Gameplay

Players play cards 40 to move, attack, defend, and do special actions. They roll dice 33 to determine combat results.

Action System

Each player for game action FIGS. 10B and 10W has two actions per turn. Actions are usually spent to play cards 40, but they can also be used to activate special abilities or terrain (like a siege cannon). Most cards 40 cost one action but some cost two actions and some are free.

Cards 40

There are lots of card 40 types: attack, defense, move, special, terrain, unit, etc. These cards 40 are designed as a fully realized card game, with deck building rules, keywords, combos, and so on. Each game action FIG. 10 comes with a fixed set of cards themed for a particular action figure such as 10B or 10W.

String 30

The measuring string 30 is broken up into three colored sections, all having lengths the equivalent of twice the diameter of hex spacer/platform 31 in length: green, yellow, and red. String 30 is used for line of movement, movement length, distance of range attacks and line of sight for range attacks. The colors of string 30 are for different movement and range lengths. For example, short ranged attacks just use the green part of the string 30.

Movement

Game action FIGS. 10B, 10W move by placing a clear plastic base where they'd like to end up, then using measuring string 30 to make sure it's a legal move. (Game action FIGS. 10B, 10W can move in a straight line for a certain distance, but can't move through obstacles).

A game action figure's 10B, 10W current health card determines how far it can move. As a FIG. 10B, 10W takes wounds, it usually moves slower.

While there are Move cards 40 in a game action figure's deck that have special properties (like being able to fly over obstacles), they can also make a Basic Move once per turn, at the cost of one action, without playing a card 40.

Combat

There are two types of attack cards 40: range and melee. Melee attack cards 40 can only be played when a figure's 10B hex spacer/platform 31B is touching another figure's 10W hex spacer/platform 31W as shown in FIG. 5. The attacker rolls the dice 33 and adds-up their total symbols. The defender then rolls their dice (usually two as well but not always), hoping to roll at least as many defense symbols as the attacker rolled attack symbols. If the defender at least matches the attacker's symbols, the attack fails. Otherwise, the attack deals damage (usually one damage, but not always). Many attacks have special properties if they hit.

Advantage

One or more FIGS. 10B, 10W can have Advantage during an attack. The attacker has Advantage when it attacks from behind the defender. The defender has Advantage when it has cover during a Ranged attack. When a figure has Advantage, the side of the dice with the Advantage pips is 'live' for that figure when they roll the dice 33.

For example, a player Corbett is punching the player Lechuza from behind. The Corbett player rolls 1 green (attack) symbol and the 2 blue (advantage) symbols. The Corbett total number of symbols is 3 because Corbett is behind his defender. If Corbett were in front of the defender Lechuza, Corbett's total would only be 1 symbol. Advantage Corbett!

Game End

FIG. 6 shows the end of the game where the player using game action FIG. 10B has been defeated (toppled) by the player using game action FIG. 10W. The game can be played in a variety of ways (free-for-all, duel, team, scenario, etc.). The default game ends when one figure or team is the last figure standing.

Thus, specific embodiments of a game using action figures having game pieces stored inside a pair of opposing housings has been described and illustrated in detail. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A game action figure, for use in a tabletop combat game with other game action figures, comprising:

a body having arms and legs;

a lower housing, the lower housing including a first storage location for a pair of dice, a second storage location for a set of cards, a hex spacer/platform, and a weapon held by one of the arms during game play, and a third storage location for a measuring string; and an upper housing, the upper housing configured to attach to the lower housing and enclose a space between the lower and upper housing in which the set of cards, hexagonal spacer and measuring string are stored.

2. The game action figure of claim 1, wherein the first storage location includes a pair of apertures, each dimensioned to retain one die of the pair of dice.

3. The game action figure of claim 1, wherein the cards are hexagonal in shape.

4. The game action figure of claim 1, wherein the third storage location includes a pair of holes in which ends of the string are placed and inserted into the lower housing.

5. The game action figure of claim 1, wherein the lower housing and upper housing together present a head for the game action figure supported by the body having arms and legs.

6. The game action figure of claim 1, wherein the hex spacer/platform is made from a transparent material.

* * * * *